US009482001B2

(12) United States Patent
Sareyka et al.

(10) Patent No.: US 9,482,001 B2
(45) **Date of Patent: *Nov. 1, 2016**

(54) SUSPENDED CEILING GRID ADAPTER

(71) Applicant: Worthington Armstrong Venture, Malvern, PA (US)

(72) Inventors: Brett Wayne Sareyka, Glen Mills, PA (US); Joshua Lee Neal, Elverson, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/918,965

(22) Filed: Oct. 21, 2015

(65) Prior Publication Data

US 2016/0040426 A1 Feb. 11, 2016

Related U.S. Application Data

(60) Continuation-in-part of application No. 14/448,090, filed on Jul. 31, 2014, now abandoned, which is a division of application No. 13/573,280, filed on Sep. 8, 2012, now Pat. No. 8,839,583.

(51) Int. Cl.
*E04B 9/30* (2006.01)
*E04B 9/12* (2006.01)

(52) U.S. Cl.
CPC ..... *E04B 9/122* (2013.01); *E04B 9/127* (2013.01)

(58) Field of Classification Search
CPC ..... E04B 9/122; E04B 9/127; E04B 9/30; Y10T 403/4631; Y10T 403/3993
See application file for complete search history.

(56) References Cited

U.S. PATENT DOCUMENTS

| | | | | |
|---|---|---|---|---|
| 4,535,580 | A * | 8/1985 | Shirey | E04B 9/10 52/506.06 |
| 5,044,138 | A * | 9/1991 | Zaccardelli | E04B 9/122 52/506.07 |
| 5,046,294 | A * | 9/1991 | Platt | E04B 9/30 52/506.06 |
| 5,149,221 | A * | 9/1992 | Slapsys | E04B 9/122 403/201 |
| 5,154,031 | A * | 10/1992 | Wall | E04B 9/10 403/346 |
| 5,572,844 | A * | 11/1996 | Stackenwalt | E04B 9/30 52/506.07 |
| 5,839,246 | A * | 11/1998 | Ziegler | E04B 9/068 403/347 |
| 6,178,712 | B1 | 1/2001 | Sauer | |
| 7,293,393 | B2 | 11/2007 | Kelly et al. | |
| 7,673,429 | B2 | 3/2010 | Frecska | |
| 7,926,238 | B2 | 4/2011 | Sareyka et al. | |
| 7,930,864 | B2 | 4/2011 | Wendt | |
| 8,813,457 | B2 * | 8/2014 | Underkofler | E04B 9/30 248/221.11 |
| 9,115,488 | B2 * | 8/2015 | Jankovec | E04B 9/127 |
| 2010/0095627 | A1 * | 4/2010 | Meres | E04B 9/241 52/506.07 |

* cited by examiner

*Primary Examiner* — Rodney Mintz
*Assistant Examiner* — Daniel Kenny
(74) *Attorney, Agent, or Firm* — Stradley Ronon Stevens & Young, LLP

(57) ABSTRACT

An adapter for securing a cross beam to a main beam in a suspended ceiling. The adapter includes a first leg having a ramp portion on a top edge of the first leg and a hook portion on a bottom edge of the first leg, a second leg attached to the first leg on a first side of the first leg. The second leg includes a larger portion which extends above the first leg to a second side of the first leg.

13 Claims, 8 Drawing Sheets

SUSPENDED CEILING GRID ADAPTER

CROSS-REFERENCE TO RELATED APPLICATION

This application is a continuation-in-part of U.S. patent application Ser. No. 14/448,090, filed Jul. 31, 2014, which is a divisional of U.S. patent application Ser. No. 13/573,280, filed Sep. 8, 2012, the entire disclosure of which is incorporated herein by reference.

TECHNICAL FIELD

Suspended ceilings are used extensively in commercial and industrial buildings. In such ceilings, a metal grid framework of interconnected main beams and cross beams is hung from a structural element by wires. The grid supports acoustical panels in rectangular openings formed in the grid.

PRIOR ART

Suspended ceilings having metal beams interconnected into a grid that supports panels are well known. U.S. Pat. No. 5,839,246 and U.S. Pat. No. 6,178,712, for instance, incorporated herein by reference, show such ceilings.

Such prior art suspended ceilings generally have a grid of inverted T-beams, rolled from sheet metal, arrayed in rectangular fashion that is suspended from a structural ceiling by wires. The grid is created from main beams that extend longitudinally parallel to each other, and opposing cross beams connected at right angles to a main beam, to form repetitive rectangles that receive and support panels. The repetitive rectangles are generally formed in even rows, and extend side-by-side. The connections are formed by creating slots in the main beams that receive identical connectors on the end of the cross beams. In a connection, the connectors on each of a first and second opposing cross beams are connected through a slot in the main beam to each other, and to the main beam, so that a secure and strong connection results between the opposing cross beams and the main beam. If only a first connector is inserted into the slot, without being connected to an opposing identical second connector, the connection will not hold. The first connector is only loosely held in the slot until the second connector on the second opposing beam is forced into the slot along the first connector. The present invention relates to such connection.

SUMMARY

The adapter of the present invention enables a strong connection between a single cross beam and a main beam, through a slot in the main beam, in a ceiling grid, using some of the same prior art connector elements used to make a two cross beam connection through a slot, as described above. Such a connection is, in some instances, desired for a decorative effect, wherein an area, or areas, of the ceiling are clear of a cross beam that extends in line with an opposing cross beam. This results in a type of running brick bond design, such as used in a brick wall. In other instances, the omission of a second opposing cross beam is necessary to create an open area to accommodate a ceiling fixture, such as a fluorescent light fixture, or a ventilator.

It is necessary under building codes that all cross beams be retained in their connections under stress, for instance, of a 180 pound pull, particularly during seismic events, so the ceiling does not collapse. The connection of the invention between a single cross beam and, using the adapter disclosed, a main beam, complies with such a requirement, based on laboratory tests.

The present invention comprises an L-shaped adapter. A first leg of the adapter is inserted from the side opposite the first cross beam, through the slot in the main beam, alongside a first connector on the opposing first cross beam, that has already been inserted into the slot. The adapter provides a means to keep the connector on the first cross beam engaged with the main beam, since the adapter occupies the space in the slot that in the prior art is occupied by the omitted second connector on the end of the omitted second beam.

The first leg of the L-shaped adapter extends to and along the web of the first cross beam already in the slot, and is secured to the cross beam by, for instance, a rivet.

The second leg of the L-shaped adapter extends along the web of the main beam, on the side of the main beam opposite the first cross beam.

This arrangement prevents a pull out of the first cross beam from the slot in the main beam, under stress, such as in a seismic event.

The present connection, notwithstanding there is an omitted second connector and second cross beam from the connection of the prior art, will retain its resistance to separation of the first cross beam and first connector, in compliance with governing codes, from the main beam, based on laboratory tests.

In summary, with the present invention, a conventional prior art suspended ceiling designed to have opposing first and second cross beams connect with each other, and with a main beam, can be readily adapted to a connection having only a single first beam connected through a slot in the main beam.

DETAILED DESCRIPTION

Prior Art

Figure 1:
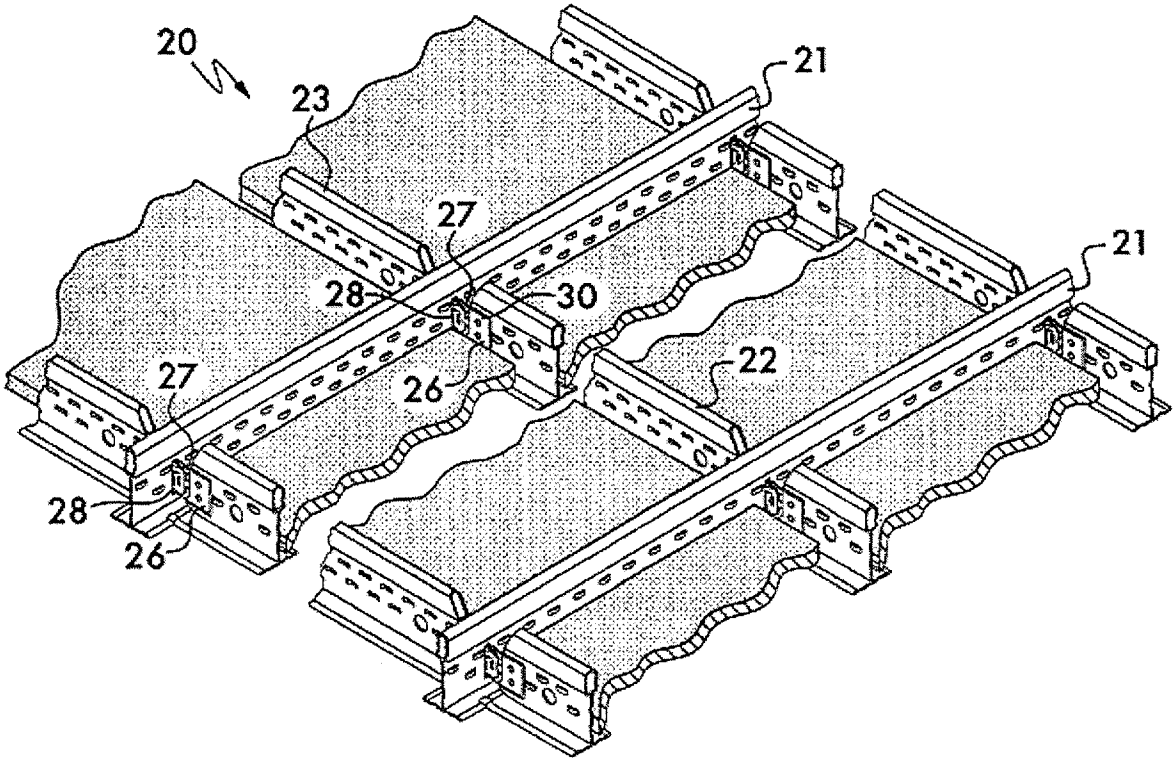
FIG. 1 (Prior Art)
FIG. 1 is a perspective view taken from above, of a prior art suspended ceiling.

There is shown in FIG. 1 a prior art suspended ceiling 20 having parallel spaced main beams 21 and first and second identical opposing cross beams 22 and 23. First cross beam 22 has affixed at its end the first connector 26, and second cross beam 23 has affixed at its end an identical second connector 27. The first and second connectors 26 and 27 extend through a slot 28 in the main beam 21, from opposing sides of the main beam 21, and lock with each other (sometimes styled a "handshake" in the prior art) and with the main beam 21 to form a connection 30.

As well known in the art, such a connection 30 must have opposing connectors, (such as the first and second connectors 26 and 27) extending through the slot 28 beside each other and in close contact with each other. A single connector in the slot, such as the first connector 26, simply pulls out since a single connector in the slot 28 is a loose fit. A first connector 26 in the slot, is designed to lock with the opposing second connector 27 in the slot 28 in a confined space. The opposing first and second connectors 26 and 27 fully occupy the slot. A flexible tab 31 flexes when a second connector 27 goes through the slot 28, and then expands to lock to the slot 28, but does not establish a secure connection on its own.

Figure 2:
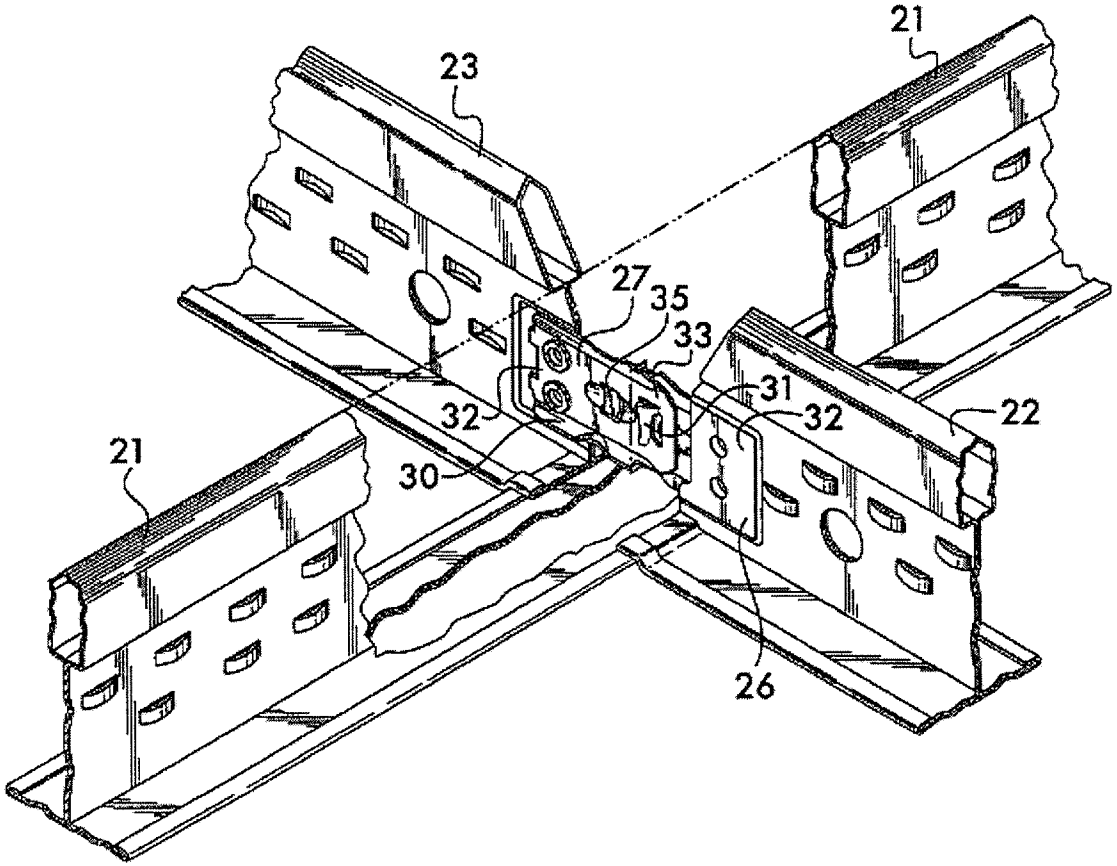
FIG. 2 (Prior Art)
FIG. 2 is an enlarged perspective view taken from above of a connection between a main beam and opposing cross beams, in the ceiling shown in FIG. 1, with a portion of the connection broken away.

As seen in FIGS. 1 and 2, each of the first and second connectors 26 and 27 has a body portion 32 and the tab 33 that engages the side of the slot 28 to prevent withdrawal when opposing first and second connectors 26 and 27 are in the slot. A barb 35 on each of the first and second connectors 26 and 27 that engage one another when the second opposing connector 27 on second opposing cross beam 23 is inserted into the slot 28. Such an arrangement is shown in greater detail in U.S. Pat. No. 5,839,246 and U.S. Pat. No. 6,178,712 as referred to above.

Present Invention

The following description of some embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 3:
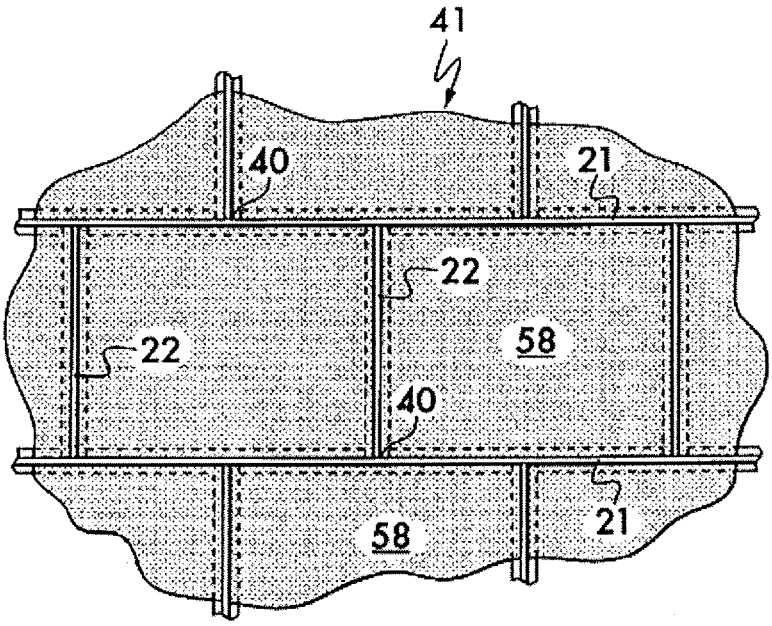
FIG. 3 is a view looking downward of a suspended ceiling that is using the adapter of the invention to connect a first cross beam only to a main beam, to create a running bond effect.

The present invention is concerned with adapting the prior art connection 30 as described above, with first and second opposing cross beam 22 and 23, into a connection 40 between a single first cross beam 22, and a main beam 21, that results in a grid 41, as depicted in FIG. 3. One or more of the connections 40 can be used in such grid 41. In the connection 40 of the invention, the second cross beam 23 and second connector 27 are omitted from the prior art connection 30, and an adapter 42 of the invention inserted in their place. The adapter of the present invention enables a strong connection 40 between a single cross beam 22 and a main beam 21, through a slot 28 in the main beam 21 using some of the same prior art connector elements used to make a two cross beam connection through a slot, as described above. Such a connection 40 is, in some instances, desired for a decorative effect, wherein an area, or areas, of the ceiling are clear of a cross beam that extends in line with an opposing cross beam. This results in a type of running brick bond design, such as used in a brick wall. In other instances, the omission of a second opposing cross beam is necessary to create an open area to accommodate a ceiling fixture, such as a fluorescent light fixture, or a ventilator.

It is necessary under building codes that all cross beams be retained in their connections under stress, for instance, of a 180 pound pull, particularly during seismic events, so the ceiling does not collapse. The connection 40 of the invention between a single cross beam 22 and, using the adapter 42 disclosed, a main beam 21, complies with such a requirement, based on laboratory tests.

Figure 4A:
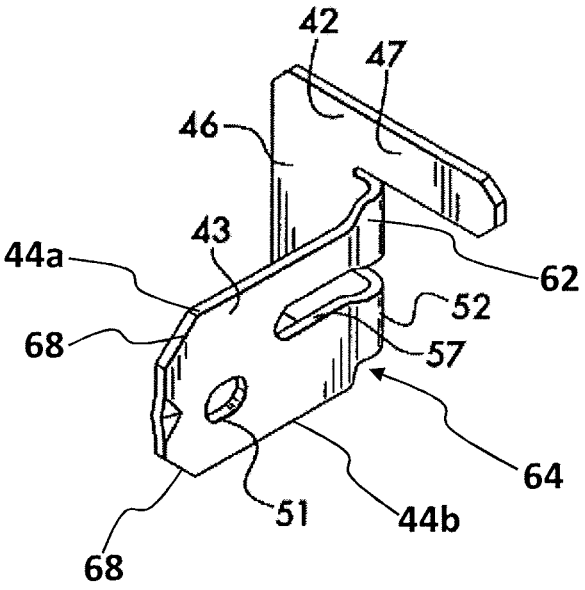
FIG. 4A is a perspective view of the adapter of the invention.
Figure 4B:
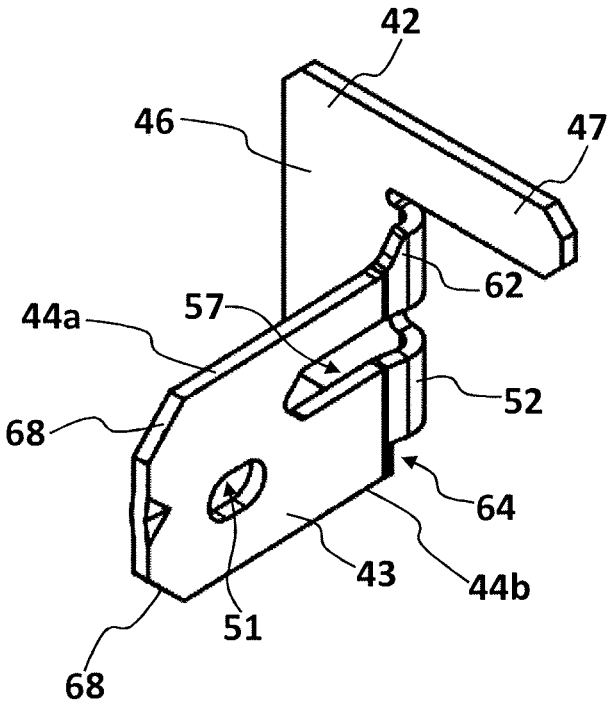
FIG. 4B is another perspective view of the adapter of the invention.
Figure 4C:
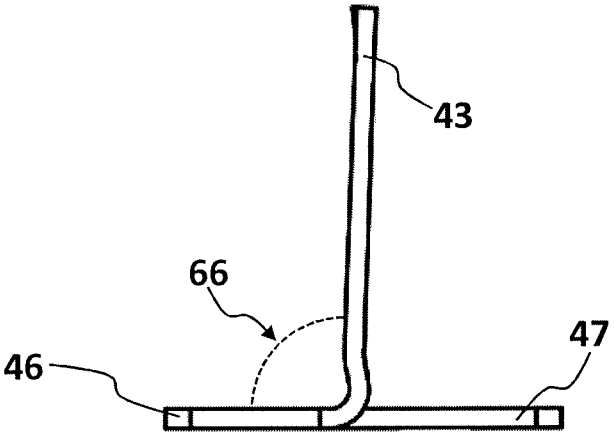
FIG. 4C is a bottom view of the adapter of the invention.
Figure 4D:
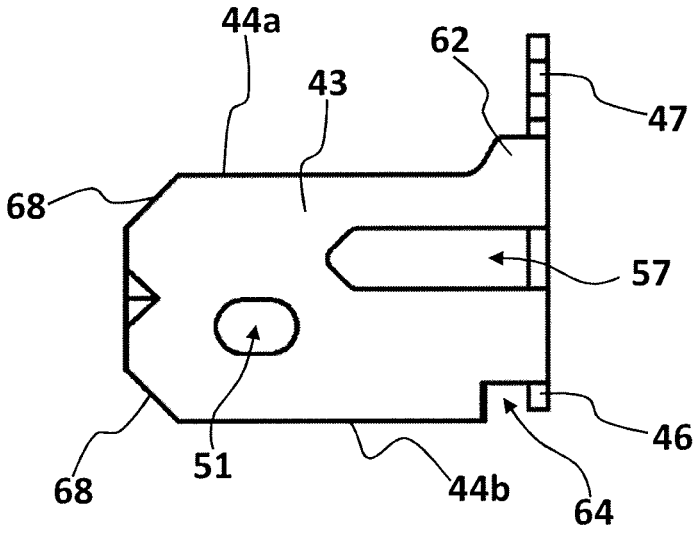
FIG. 4D is a side view of the adapter of the invention.
Figure 4E:
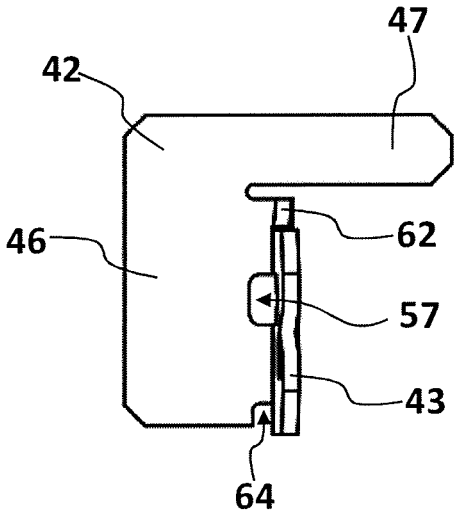
FIG. 4E is a side view of the adapter of the invention.
Figure 5:
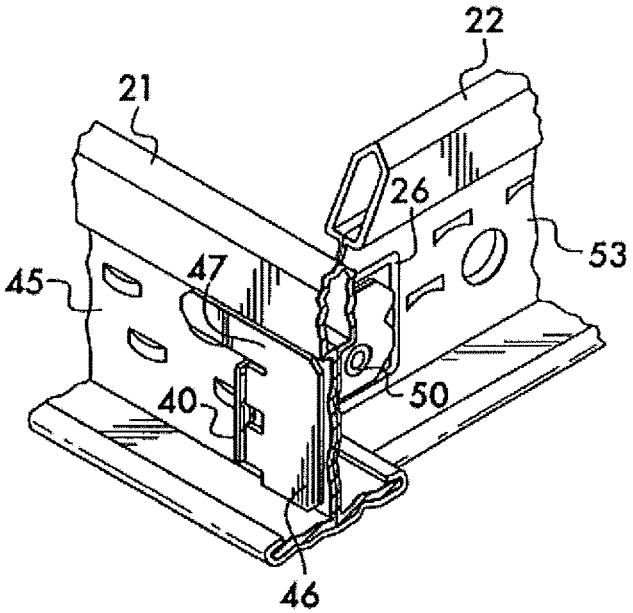
FIG. 5 is a perspective view of a connection between a main beam, and a single first cross beam, using the adapter of the invention.
Figure 6:
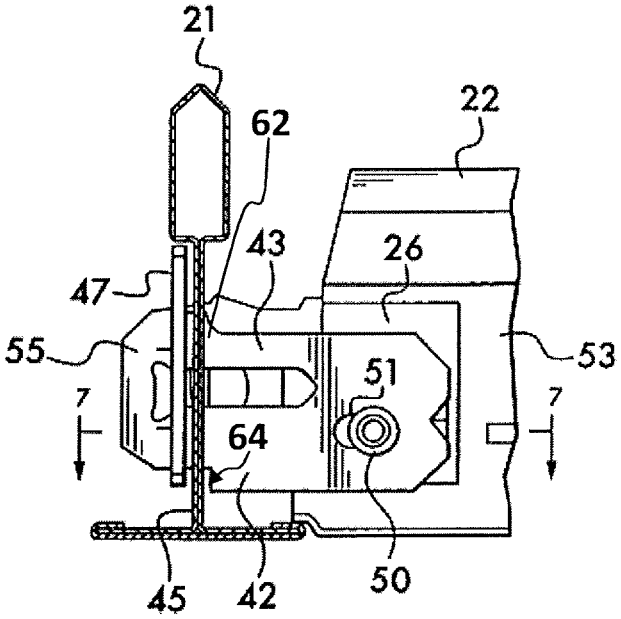
FIG. 6 is a side elevational view of the connection of FIG. 5.
Figure 7:
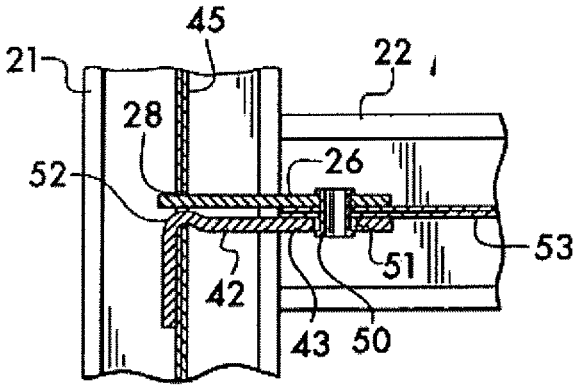
FIG. 7 is a sectional view of the connection of the invention taken on the line 7-7 in FIG. 6.
Figure 8:
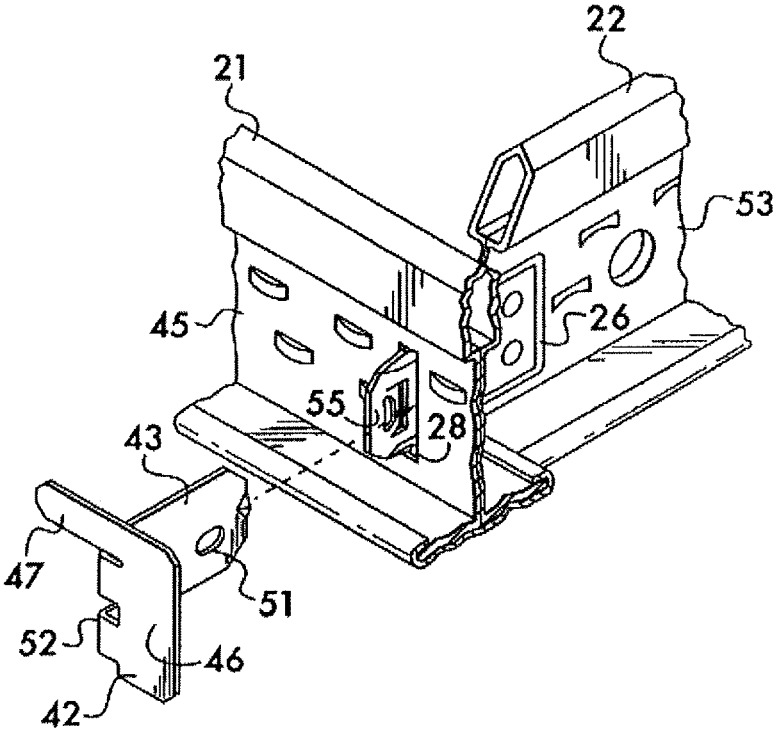
FIG. 8 is a perspective view of the connection of the invention with a first cross beam inserted into the slot of a main beam, and the adapter about to be inserted into the slot, from the side opposite the first cross beam.

The adapter 42, as seen in FIGS. 4A-4E includes a first leg 43 attached to a second leg 46 at an offset portion 52. As best seen in FIG. 4C, the offset portion 52 is curved in shape and has an arc length of greater than 90 degrees so that the offset portion 52 begins to curve back toward the second leg 46. The first leg 43 then attaches to the offset portion 52 at an angle opposite the curvature of the offset portion 52, such that the first leg 43 forms an angle 66 with the second leg 46 of greater than 90 degrees.

The first leg 43 of the adapter 42 includes a ramp portion 62 on a top edge **44*a* of the first leg 43 and a hook portion 64 on a bottom edge 44*b* of the first leg 43. The first leg 43 also includes a slot 57 and an elongated rivet hole 51 between the top edge 44*a* and the bottom edge 44*b*. The first leg 32 may also include chamfered corners 68. The second leg 46 of the adapter includes a larger portion 47 which extends above and across the first leg 47**.

Referring to FIGS. 5-8, to install the adapter 42, the first connector 26 is initially inserted through the slot 28 in the main beam 21 from a first side of the main beam 21. The first leg 43 of the adapter 42 is then inserted through the slot 28 in the main beam 21, with the direction of insertion being substantially parallel to the main beam 21 until the ramp portion 62 reaches the slot 28. Once the ramp portion 62 reaches the slot 28, contact between the web 45 of the main beam 21 and the ramp portion 62 drives the adapter 42 downward into a secured position. The smooth bend of the offset portion 52 allows the first connector 26 to slide past the adapter 42 while the adapter 42 is being inserted. The slot 57 in the first leg 43 of the adapter 42 permits an easier installation of the clip in its position alongside the first connector 26, as seen, for instance, in FIG. 7. Once in the secured position, the hook portion 64 prevents the adapter 42 from being pulled back through the slot 28. The adapter 42 may then be secured to the cross beam 22 by a rivet 50 or other fastener which pass through the elongated rivet hole 51, the web 53 of the cross beam 22, and the first connector 26. The elongated rivet hole 51 is slotted to compensate for any variance in the position of the first cross beam 22 and the first connector 26 with respect to the main beam 21.

Once installed, the second leg 46 of the adapter 42 lies along the web 45 of the main beam 21. The larger portion 47 of the second leg 46 extends above and across the slot 28 to prevent the adapter 42 from being pulled through the slot 28. The first leg 43 extends along the first connector 26, in place of the prior art second connector 27 shown in FIG. 2. The first leg 43 of the adapter 42 of the invention holds the first connector 26 in place against the edge of the slot 28 of the main beam 21, to prevent withdrawal, as did the omitted second connector 27 in the prior art. The offset portion 52 permits the web 53 of the first cross beam 22 to be sandwiched between the first leg 43 of the adapter 42 and the first connector 26, as seen best in FIG. 7.

Figure 9:
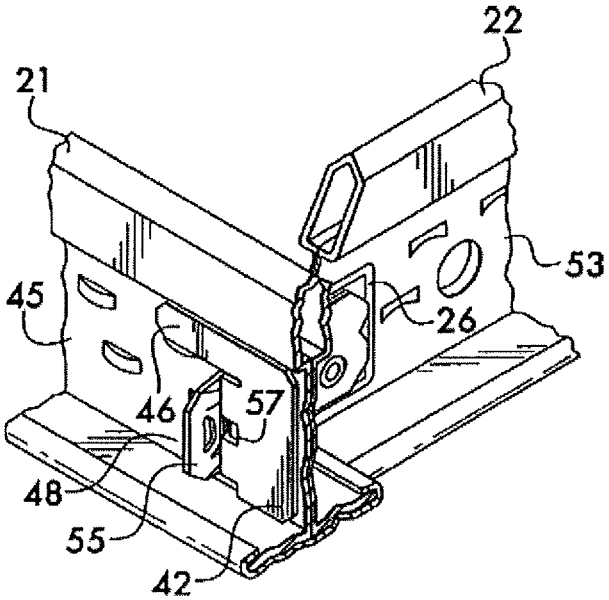
FIG. 9 is a perspective view of the connection of the invention, showing a portion of the connector on the first cross beam extending beyond the web of the main beam, on the side opposite the first cross beam, with the adapter of the invention in place.
Figure 10:
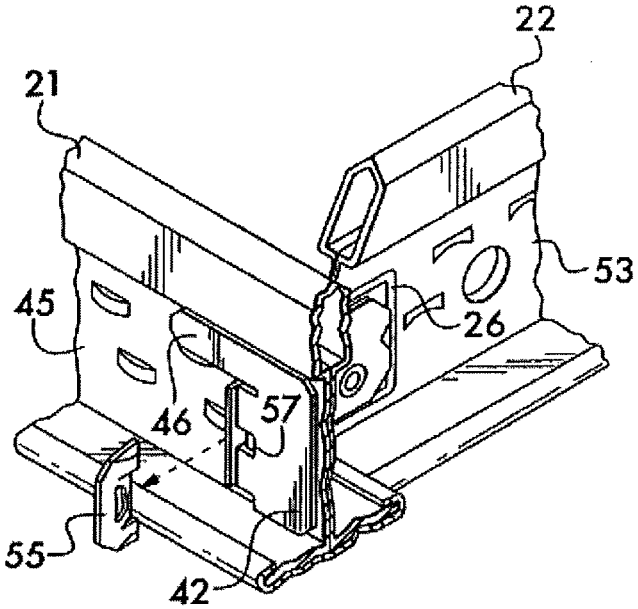
FIG. 10 is the perspective view of FIG. 9, with the portion of the connector extending beyond the web of the main beam cut away.

In the arrangement as shown in FIG. 9, the connection of the invention is complete, except for the end 55 of the first connector 26 which extends beyond web 45 of the main beam 21. End 55 of the first connector 26 is manually cut off as seen in FIG. 10, so that there is no interference with a panel 58 that extends across the connection, as seen in FIG. 3.

In the connection of the invention 40 as described, using the adapter 42 of the invention, the first connector 26 on the first opposing cross beam 22, is prevented from withdrawing from slot 28 of main beam 21 by (1) the connection of first connector 26 to the side of the slot 28, and by (2) the rivet 51 which secures the first leg 43 of the adapter 42 to the first connector 26, with the second leg 46 of the adapter extending along, and against the web 45 of the main beam 21 on the side of the main beam 21 opposite the first cross beam 22, so the adapter cannot be pulled through the slot 28. The adapter 42 is prevented from backing out of the slot 28 by hook portion 64.

What is claimed:

1. A suspended ceiling comprising:

a main beam including a slot;

a cross beam perpendicular to the main beam;

a connector attached to the cross beam and extending through the slot in the main beam; and an adapter for connecting the main beam to the first cross beam, the first adapter having:

a first leg extending through the slot in the main beam and connected to the connector attached to the cross beam, wherein the first leg includes a ramp portion and a hook portion which prevents the first leg from withdrawing from the slot;

a second leg on an opposite side of the main beam from the first cross beam lying along the main beam, wherein the second leg includes a larger portion extending above and across the slot in the main beam and wherein the adapter prevents withdrawal of the first cross beam from the main beam.

2. The suspended ceiling of claim 1, wherein the first leg includes a hole and further comprising a rivet passing through the connector and the hole in the first leg, the rivet connecting the first adapter to the connector.

3. The suspended ceiling of claim 2, wherein the hole is elongated to allow for variance in the position of the first cross beam and the main beam.

4. The suspended ceiling of claim 1, wherein the first leg has a slot for facilitating installation of the adapter alongside the connector.

5. The suspended ceiling of claim 1, wherein:

an end of the connector extends beyond the first adapter, and the end of the connector is adapted to be cut off from the remainder of the connector.

6. The suspended ceiling of claim 1, wherein the first cross beam is prevented from withdrawing from the main beam by the connection between the first leg and the connector.

7. The suspended ceiling of claim 1, wherein the first cross beam is prevented from withdrawing from the main beam by the first cross beam connecting to the side of the first slot in the main beam.

8. The suspended ceiling of claim 1, wherein the first leg of the adapter is attached to the second leg of the adapter at an offset portion.

9. A suspended ceiling comprising:

a main beam having a first slot and a second slot;

a first cross beam perpendicular to the main beam, wherein the first cross beam is attached to a first connector extending through the first slot;

a second cross beam perpendicular to the main beam, on an opposite side of the main beam from the first cross beam and offset from the first cross beam, wherein the second cross beam is attached to a second connector extending through the second slot;

a first adapter connecting the main beam to the first cross beam, the first adapter having a first leg extending through the first slot and connected to the first connector and a second leg on an opposite side of the main beam from the first cross beam lying along the main beam, wherein the first leg includes a ramp portion and a hook portion which prevents the first leg from withdrawing from the first slot and the second leg includes a larger portion extending above and across the first slot in the main beam;

a second adapter connecting the main beam to the second cross beam, the second adapter having a first leg extending through the second slot and connected to the second connector and a second leg on an opposite side of the main beam from the second cross beam lying along the main beam, wherein the first leg includes a ramp portion and a hook portion which prevents the first leg from withdrawing from the second slot and the second leg includes a larger portion extending above and across the second slot in the main beam;

a first rivet passing through the first connecter and a hole in the first leg of the first adapter; and a second rivet passing through the second connecter and a hole in the first leg of the second adapter.

10. The suspended ceiling of claim 9, wherein:

the hole in the first leg of the first adapter is elongated to allow for variance in the position of the first cross beam and the main beam and the hole in the first leg of the second adapter is elongated to allow for variance in the position of the second cross beam and the main beam.

11. The suspended ceiling of claim 9, wherein an end of the first connector extends beyond the first adapter and an end of the second connector extends beyond the second adapter, wherein the ends of the first connector and the second connector are adapted to be cut off from the remainder of the first connector and the second connector.

12. The suspended ceiling of claim 9, further comprising a first panel extending across the main beam and the first cross beam and a second panel extending across the main beam and the second cross beam.

13. The suspended ceiling of claim 9, wherein the first leg of the first adapter is attached to the second leg of the first adapter at a first offset portion and wherein the first leg of the second adapter is attached to the second leg of the second adapter at a first offset portion.

* * * * *